US006186777B1

(12) United States Patent
Ferrara et al.

(10) Patent No.: US 6,186,777 B1
(45) Date of Patent: Feb. 13, 2001

(54) UTILITY LIGHTER PLATFORM

(75) Inventors: Daniel Ferrara, Bantam; Brian Tubby, Milford; Paul Adams, Monroe, all of CT (US)

(73) Assignee: BIC Corporation, Milford, CT (US)

( * ) Notice: Under 35 U.S.C. 154(b), the term of this patent shall be extended for 0 days.

(21) Appl. No.: 09/239,807

(22) Filed: Jan. 29, 1999

Related U.S. Application Data

(63) Continuation-in-part of application No. 08/787,399, filed on Jan. 22, 1997, now Pat. No. 6,086,360, and a continuation-in-part of application No. 08/917,134, filed on Aug. 25, 1997, now Pat. No. 5,934,895.

(51) Int. Cl.[7] ..... F23D 14/62

(52) U.S. Cl. ..... 431/345; 431/344; 431/255; 431/266; 431/143

(58) Field of Search ..... 431/345, 344, 431/255, 153, 266, 264, 142, 143; 126/405, 406, 407, 401, 402, 403, 404, 408–414, 229, 231, 25 B

(56) References Cited

U.S. PATENT DOCUMENTS 1,931,083 * 10/1933 Rodler ..... 431/266
4,253,818 * 3/1981 Ogawa et al. ..... 431/142
4,315,731 * 2/1982 Moore ..... 431/345
4,419,072 * 12/1983 Nakagawa et al. ..... 431/344
4,538,983 * 9/1985 Zeller et al. ..... 431/255
4,859,172 * 8/1989 Nitta ..... 431/153
5,322,433 * 6/1994 Shike et al. ..... 431/266
5,485,829 * 1/1996 Santhouse et al. ..... 431/345
5,531,592 * 7/1996 Tsai ..... 431/345
5,573,393 * 11/1996 Tsai ..... 431/344

* cited by examiner

*Primary Examiner*—Ira S. Lazarus
*Assistant Examiner*—Josiah C. Cocks
(74) *Attorney, Agent, or Firm*—Pennie & Edmonds LLP

(57) ABSTRACT

The present invention relates to a utility lighter platform which includes a lighting mechanism configured to selectively ignite fuel supplied from a fuel supply container, and a frame configured to operatively house the lighting mechanism and configured to receive an outer shell thereon. The frame includes a fuel supply container housing structure configured to hold a fuel supply container at a first end of the frame and an insulating cap holding structure configured to receive an insulating cap at a second end of the frame and configured to house a nozzle operatively connected to the fuel supply. The frame also includes an ignitor assembly holding structure configured to house an ignitor assembly, and a trigger holding structure configured to operatively hold a trigger stem with which to activate the ignitor assembly and to release fuel from the fuel supply in order to ignite fuel received at the nozzle.

25 Claims, 6 Drawing Sheets

UTILITY LIGHTER PLATFORM

CROSS-REFERENCE TO RELATED APPLICATIONS

This is a continuation-in-part of application Ser. No. 08/787,399, filed Jan. 22, 1997 now U.S. Pat. No. 6,086,360, and No. 08/917,134, filed Aug. 25, 1997 now U.S. Pat. No. 5,934,895.

TECHNICAL FIELD

The present invention generally relates to general purpose utility lighters such as those used to ignite candles, barbecue grills, fireplaces and campfires. More specifically, the present invention relates to utility lighter platforms which are inner operative lighters without outer shells.

BACKGROUND OF THE INVENTION

Lighters such as those used for igniting tobacco products, such as cigars, cigarettes, and pipes, have developed over a number of years. Typically, these lighters use either a rotary friction element or a piezoelectric element to generate a spark in proximity to a nozzle emitting fuel from a fuel container. Piezoelectric mechanisms have gained universal acceptance because they are simple for adults to use. One such piezoelectric mechanism is disclosed in U.S. Pat. No. 5,262,697 ("the '697 patent"). The disclosure of the '697 patent is incorporated by reference herein.

Lighters have also evolved from the small, hand-held lighters to several forms of extended lighters. These lighters are also hand held, but are more useful for general purposes such as lighting candles, barbecue grills, fireplaces and campfires. Earlier attempts at such designs relied simply on extended actuating handles to house a typical lighter at the end. Examples of this concept are found in U.S. Pat. Nos. 4,259,059 and 4,462,791.

In addition, many utility lighters have had some form of operating mechanism to prevent unintentional operation of the lighter by adults. Often, these mechanisms take the form of on/off switches that may shut off the fuel source or may completely prevent movement of an actuator, such as a trigger assembly, on the lighter. However, the on/off switches that must be positively moved by the user between "on" and "off" positions have drawbacks. For example, an adult user may forget to move the switch back to the "off" position after use and thereby render the on/off switch ineffective.

Utility lighters also have to appeal to the changing tastes of the consumers. For instance, some consumers may prefer smaller handles. Some consumers may prefer shorter handles. Some consumers may prefer a soft feel grip or a leather grip. Some may like a full trigger guard over a partial trigger guard. Some consumers may prefer a utility lighter with smooth curves and seamless lines, while other may want pronounced lines and sharp curves. Often, the lighter manufacturer may need to redesign the entire utility lighter including the outer shell, as well as the internal mechanisms, in order to satisfy market demands.

Thus, there remains a need for a utility lighter design that can quickly and inexpensively adapt to market demand, while minimizing the need for redesigning.

SUMMARY OF THE INVENTION

These objects and advantages as well as other objects and advantages are accomplished in a utility lighter platform which comprises a lighting mechanism configured to selectively ignite fuel supplied from a fuel supply container, and a frame configured to operatively house the lighting mechanism and configured to receive an ergonomically designed outer shell thereon.

The lighting mechanism may include an ignitor assembly configured to generate a voltage between its first and second ends, a valve actuator associated with the fuel supply for selectively releasing fuel therefrom, an actuating assembly associated with the valve actuator to dispense fuel from the fuel supply and with the ignitor assembly to generate the voltage, and a latch stem associated with the actuating assembly and configured to selectively prevent operative movement of the actuating assembly.

The latch stem further comprises a hooked tab connected for biased movement relative to the actuating assembly and normally biased into engagement with the actuating assembly to prevent the operative movement thereof, wherein the user may selectively bias the hooked tab out of engagement with the actuating assembly to permit operation of the actuating assembly. The latch stem is adapted to receive an aethestically pleasing cover.

The actuating assembly comprises a trigger stem extending from the frame and movable to activate the valve actuator and the ignitor assembly. The trigger stem is adapted to receive an aethestically pleasing trigger head.

In another aspect of the lighting mechanism, the actuating assembly further comprises a biased pivoting member operatively associated with the trigger and the ignitor assembly for activating at least the ignitor assembly when the trigger is moved toward the valve actuator.

The frame is further configured to operatively house the ignitor assembly, the valve actuator, the actuating assembly and the latch stem. The frame is further configured to operatively house the hooked tab, the trigger, and the biased pivoting member.

The utility lighter platform may be further provided with a supplemental frame configured to securely house the lighting mechanism when affixed to the frame.

More specifically, the frame comprises a fuel supply container housing structure configured to hold a fuel supply container at a first end of the frame, an insulating cap holding structure configured to receive an insulating cap at a second end of the frame and configured to house a nozzle operatively connected to the fuel supply, an ignitor assembly holding structure configured to house an ignitor assembly, and a trigger holding structure configured to operatively hold a trigger stem with which to activate the ignitor assembly and to release fuel from the fuel supply in order to ignite fuel received at the nozzle. The fuel supply container housing structure comprises a plurality of protruding members configured to securely hold the fuel supply container.

In addition, the insulating cap holding structure comprises a semi-cylindrically shaped body defining a hollow center therein to receive the nozzle. The ignitor assembly holding structure comprises a plurality of recesses and protruding portions for securely housing the ignitor assembly. The trigger holding structure comprises a pair of bars spaced apart from each other to operatively receive the trigger stem.

The frame can further include a wand receiving structure formed between the insulating cap holding structure and the ignitor assembly holding structure, wherein the wand receiving structure comprises a plurality of struts with recesses formed thereon to receive a conduit which connects the nozzle to the fuel supply.

Furthermore, the frame can include a latch receiving structure configured to receive a latch stem, which is adopted to prevent operative movement of the trigger stem on the frame. The latch stem receiving structure comprises at least one protruding member adapted to securely hold the latch stem.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE PREFERRED EMBODIMENTS

Figure 1:
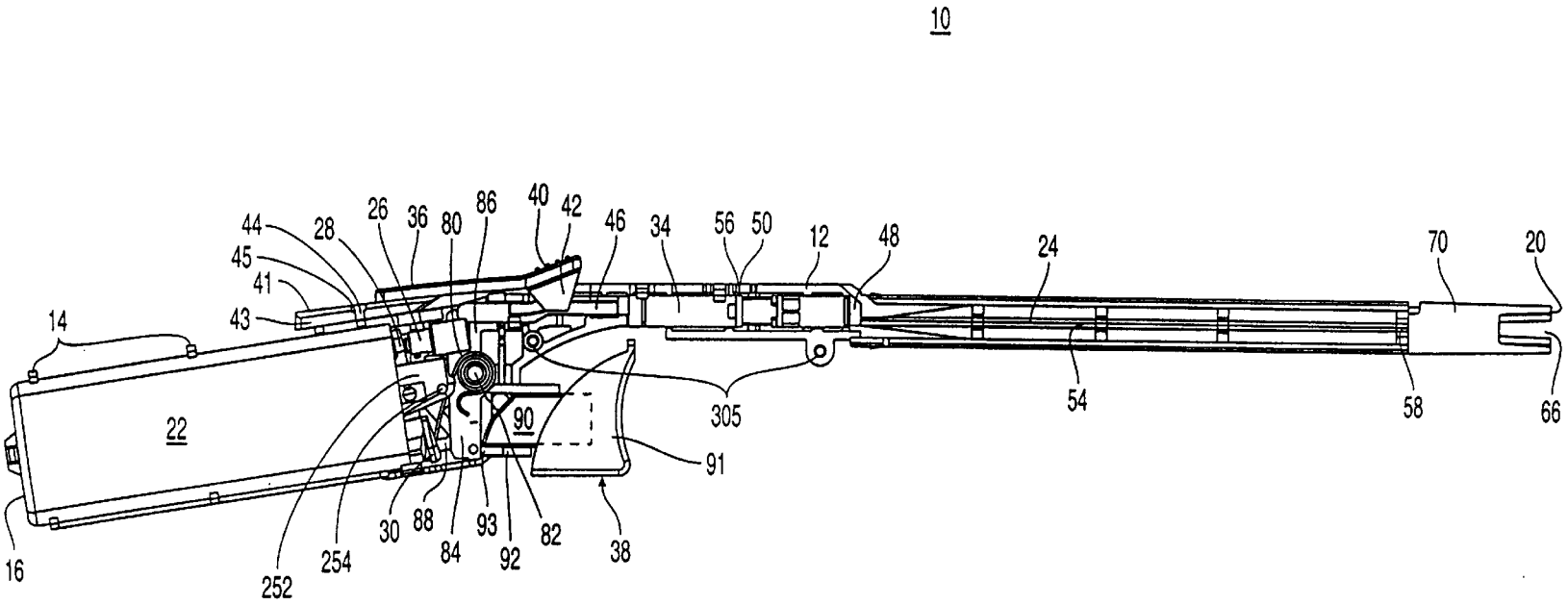
FIG. 1 is a side view of a lighting mechanism housed in a frame in accordance to the present invention.
Figure 1A:
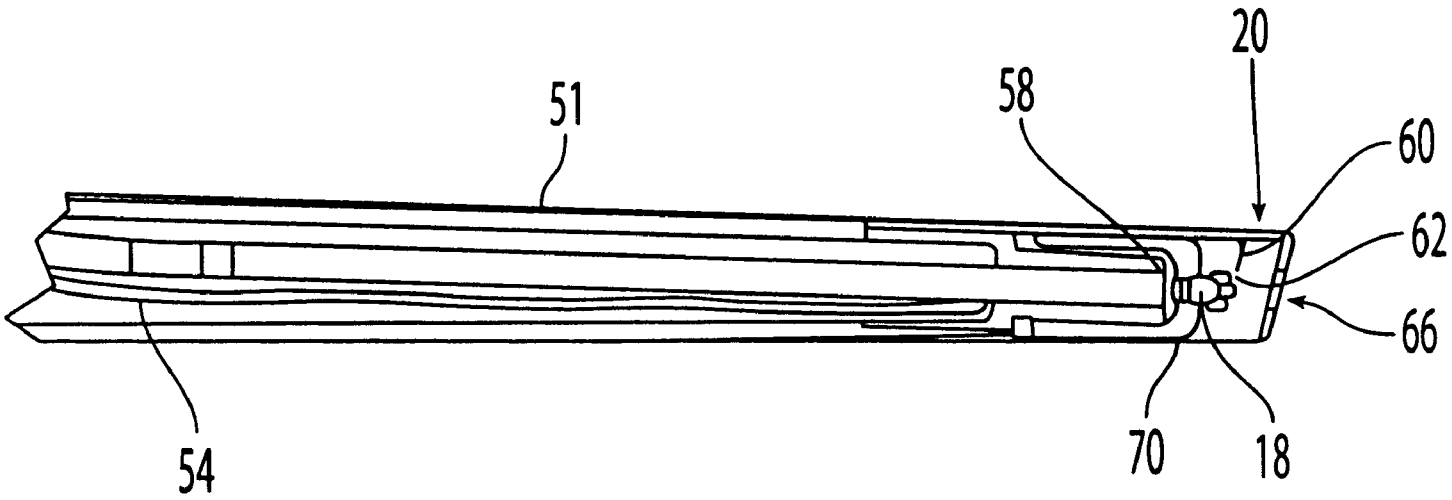
FIG. 1*a* is a side view of a portion of the second end of the utility lighter platform and frame of FIG. 1.
Figure 2:
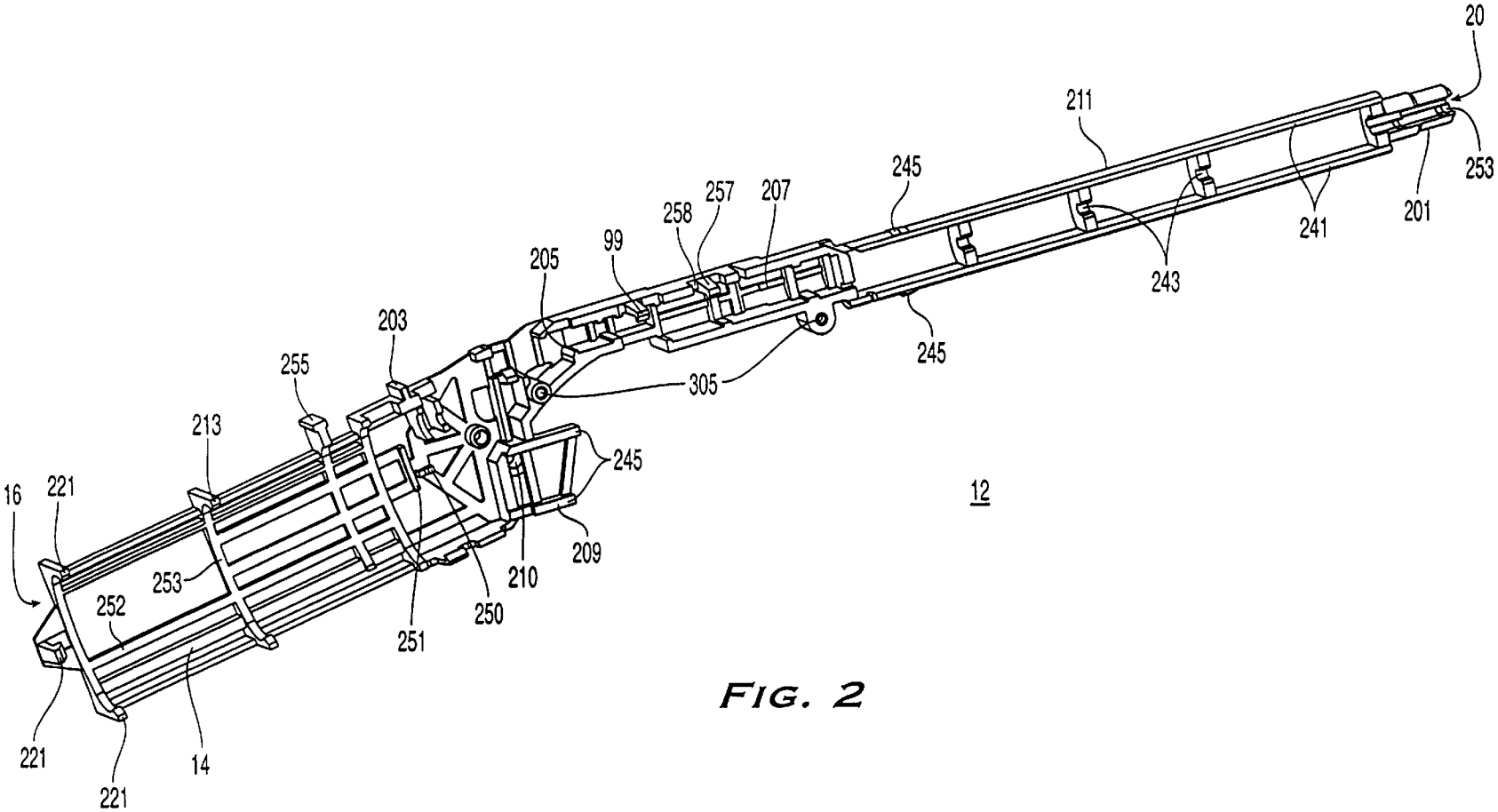
FIG. 2 is a perspective view of the frame.
Figure 5:
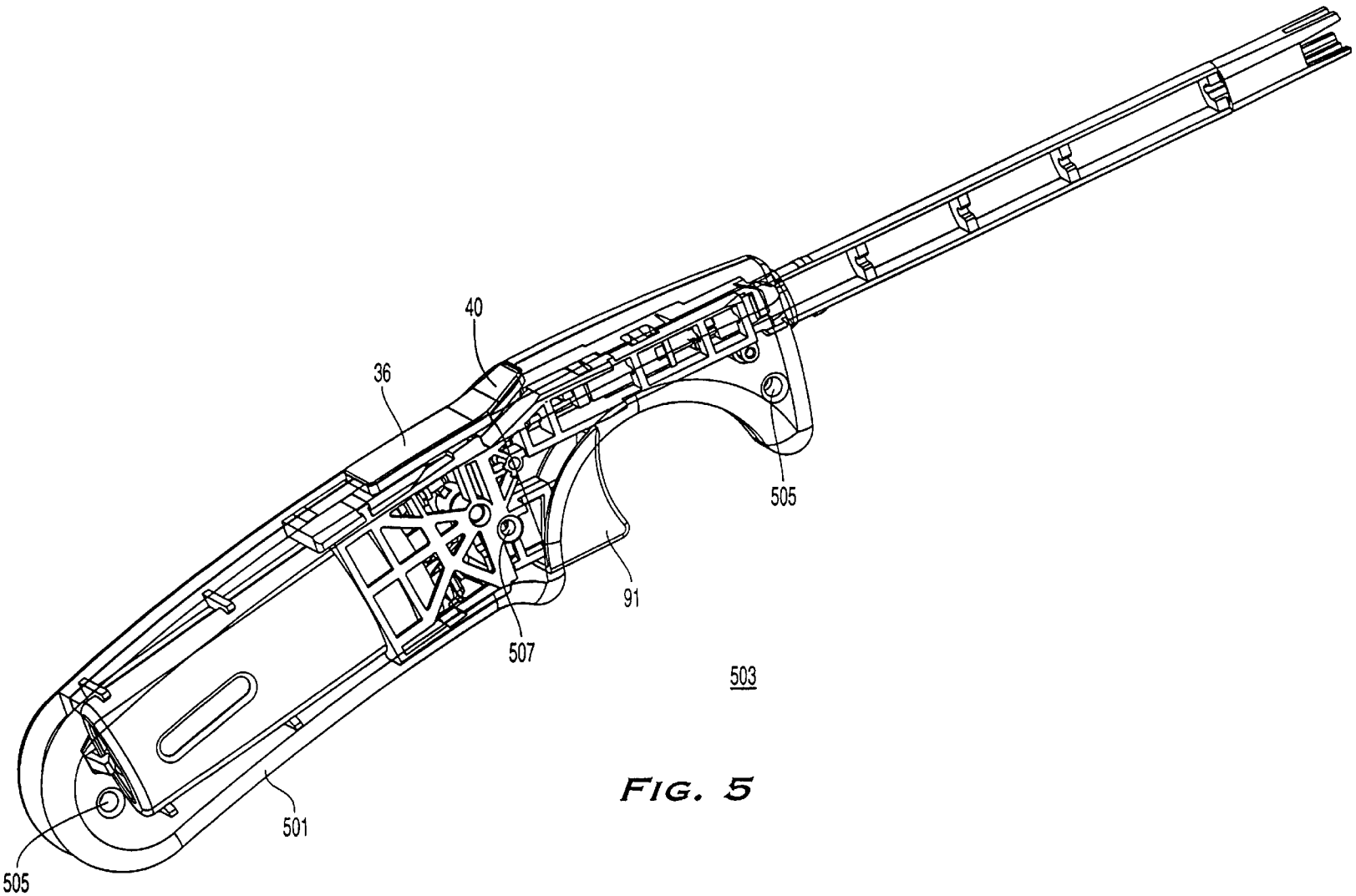
FIG. 5 is a perspective view of the utility lighter platform with an outer shell placed thereon.

Referring to FIGS. 1 and 2, a utility lighter platform 10 includes a lighting mechanism configured to selectively ignite fuel released from a fuel supply container 22. Platform 10 includes a frame 12, which is adapted to operatively house an ignitor assembly 34 and fuel supply container 22. Frame 12 is also configured to receive an aesthetically pleasing outer shell thereon. An example of an outer shell is illustrated in FIG. 5.

Frame 12 includes a fuel supply holding structure 14 located near a first end 16 to receive fuel supply container 22. A nozzle 18 is disposed near a second end 20 of frame 12 for emitting fuel to feed a flame as will be described herein. It will be noted that the terms, first end 16 and second end 20, are used to describe the present invention, and form no part of the invention.

The fuel supply container 22, which may be a butane fuel cell, is connected to one end of a conduit 24, such as a plastic tube, by a fluid connector 26. Fluid connector 26 is connected to a valve 28 on fuel supply container 22. The opposite end of conduit 24 terminates at nozzle 18 proximate second end 20.

Valve 28 is operated by a valve actuator 30, which is pivotally attached to fuel supply container 22. When valve actuator 30 is depressed as shown in FIG. 1, e.g., moved toward the first end 16, fuel is selectively released through valve 28, and flows through connector 26 and tube 24, and toward nozzle 18. An exemplary fuel supply container 22 is disclosed in U.S. Pat. No. 5,520,197 ("the '197 patent"). The disclosure of the '197 patent is incorporated herein by reference.

An actuating assembly is also provided to facilitate the depression of valve actuator 30 and to compress ignitor assembly 34 for generating a spark near the nozzle. The actuating assembly preferably comprises a trigger assembly 38, a biased pivoting member 80, and a linking rod 46 connecting pivoting member 80 to ignitor assembly 34. These components are described in detail below. Although not necessary for all aspects of this invention, an electric ignitor assembly such as a piezoelectric mechanism is the preferred ignitor for this invention. More specifically, the preferred piezoelectric mechanism is generally of the type disclosed in the '697 patent, the disclosure of which has been incorporated herein by reference.

Figure 4:
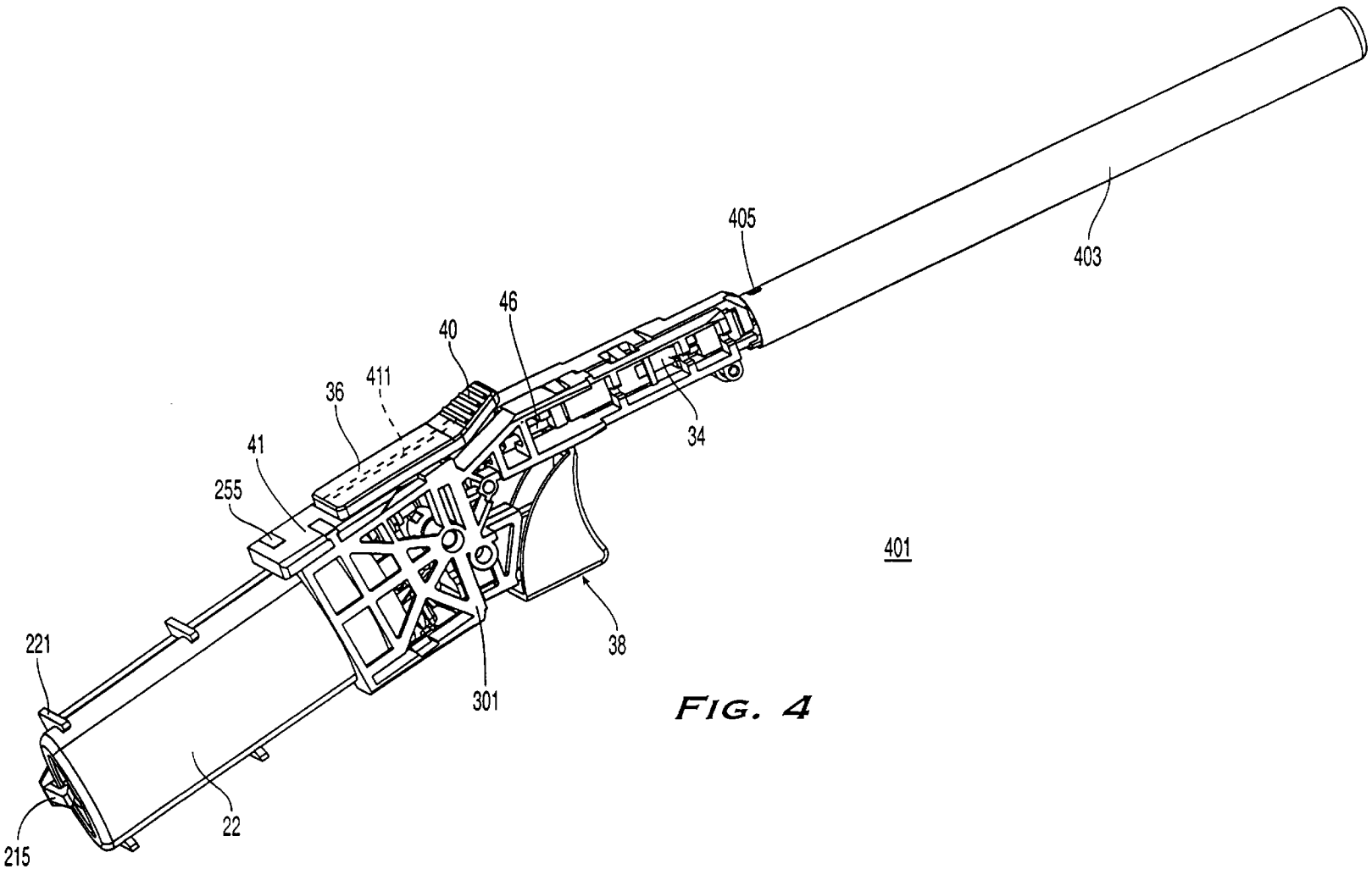
FIG. 4 is a perspective view of a functional utility lighter platform.

A latch stem 36 normally locks the actuating assembly in an inoperative position such that trigger assembly 38 may not be sufficiently depressed or pulled by a user to actuate the lighter. In a preferred embodiment, latch stem 36 generally includes an unsupported resilient front end 40 having a hooked tab 42. Hooked tab 42 is normally in engagement with a stop member structure disposed on linking rod 46. When hooked tab 42 is engaged against the stop member structure, which may be a recess formed in linking rod, linking rod 46 may not be moved in a direction toward second end 20 to significantly compress and actuate ignitor assembly 34. Furthermore, in the inoperative position latch stem 36 preferably prevents sufficient movement of trigger assembly 38 toward end 16 so as to prevent successful actuation of the utility lighter. Latch stem 36 is securely affixed to frame 12 by a latch support member 43 at a back end 41. Thus, latch stem 36 is fixedly attached to frame 12 at back end 41, and is free to flex at front end 40. A plurality of protruding members are provided on frame 12 to engage with corresponding recesses 45 formed in latch support member 43, thereby securely affixing latch stem 36 to frame 12. Latch stem 36, which can be in the form of a shank 411 as shown in FIG. 4, is adapted to receive an aesthetically pleasing cover thereon.

Piezoelectric mechanism 34 has been particularly described in the '697 patent. The details necessary to an understanding of this invention have been shown in the drawings of the '697 patent. In summary, however, piezoelectric mechanism 34 is a telescopic assembly, which may be compressed to generate a voltage between first and second electrical contacts 48, 50.

Specifically, piezoelectric mechanism 34 contains a piezoelectric crystal in electrical contact with and generally situated between electrical contacts 48, 50. Electrical contact 48 is generally referred to as an anvil and electrical contact 50 contacts an impact pad positioned on an opposite side of the piezoelectric crystal. First electrical contact or anvil 48 is in electrical contact with an electrically conductive wand 403 (as shown in FIG. 4). Conductive wand 403 is preferably made out of metal, which may be positioned over a portion of frame 12.

Second electrical contact 50 is connected to an insulated wire 54 having two exposed portions 56, 58. Exposed portion 56 is connected to contact 50, while exposed portion 58 is connected to nozzle 18. Nozzle 18 which may include a diffuser spring affixed thereto, therefore acts as an electrode and is preferably formed of an electrically conductive metal such as stainless steel brass or zinc for this purpose. A diffuser spring can be an electrically conductive coil spring, where the space between the adjacent coils of the spring is designed to allow air to mix with the released fuel to ensure a proper air/fuel mixture suitable for combustion.

Proximate second end 20, a tab or antenna 60 is stamped from wand 403 to create a spark gap 62 with the nozzle or the diffuser spring. An opening 66 at the end of conductive wand 403 allows the passage of ignited fuel from the lighter. Also, in a conventional manner, side apertures may be provided on conductive wand 403 to allow the intake of air.

In accordance with another aspect of this invention, an electrically insulating cap 70 is disposed around at least a portion of nozzle 18 and is generally located between nozzle 18 and conductive wand 403. Insulating cap 70 deters sparks from being generated between nozzle 18 and surfaces of conductive wand 403 other than at tab 60.

In another embodiment, fuel conduit 24 may be co-extruded with a conductive material along with a plastic material. For example, the plastic material may be extruded to form conduit 24 to conduct fuel gas from fuel supply container 22 to nozzle 18, and a conductive material may be extruded to form the inside or the outside of conduit 24. The conductive material preferably have exposed portions 56 and 58, arranged to make electrical contacts to contact 50 of piezoelectric element 34 and to nozzle 18 in lieu of wire 54, respectively. Alternatively, conduit 24 may be made out of a conductive material without the inner plastic material. Additionally, it may be desirable to coat, by co-extruding, an insulating layer outside of the conductive exterior to prevent electrical arcing from the conductive exterior to wand 403.

Biased pivoting member 80 of the actuating assembly is operatively connected to trigger assembly 38 and linking rod 46. Specifically, pivoting member 80 is mounted to a pin 82 in a biased manner, e.g., by a torsion spring (not shown) placed between member 80 and pin 82 such that member 80 is biased in a counterclockwise direction as viewed in FIG. 1. Alternatively, pivoting member 80 may be biased by a return spring disposed within the two telescopic members of piezoelectric mechanism 34 to maintain separation between the telescopic members. The return spring exerts a biasing force on rod 46 which is in physical contact with pivoting member 80. Such a return spring is disclosed in the '697 patent.

Biased pivoting member 80 further includes a pair of arms 84, 86 generally extending from pin 82. Arm 84 may include a knob 88 adapted to depress valve actuator 30 when the user pulls trigger assembly 38. Alternatively, a portion of trigger assembly 38 itself may be used to directly engage valve actuator 30. Additionally, a leaf spring may be disposed between trigger assembly 38 and valve actuator 30 such that fuel can be released prior to spark generation at nozzle 18 to ensure proper timing of fuel release and spark generation. Such a leaf spring is described in more details in co-pending application 08/917,134, now U.S. Pat. Ser. No. 6,086,360.

Trigger assembly 38 preferably includes a trigger stem 90 and an aesthetically pleasing trigger head 91 affixed thereto. Trigger stem 90 fits within a channel 92 of frame 12 for sliding movement relative thereto. Trigger stem 90 further includes a tab 93 that engages with the frame 12 to keep the trigger assembly 38 from completely sliding out from the frame 12. In the position shown in FIG. 1, tab 93 acts as a stop against the frame 12 to prevent further movement of trigger assembly 38 away from the valve actuator 30. Other features that limit forward or rearward movements of the trigger assembly 38 can also be used.

Alternatively, trigger assembly 38 may directly actuate both the valve actuator and the ignitor assembly. In other words, trigger assembly 38 may directly depress the valve actuator and directly compress the piezoelectric ignitor. This type lighting mechanism is also within the scope of this invention. Other aspects of the lighting mechanism are taught in co-pending U.S. patent application Nos. 08/787,399, now U.S. Pat. No. 5,934,895, and 08/917,134, now U.S. Pat. No. 6,086,360, which are incorporated herein in their entirety.

Referring to FIG. 2, frame 12 may primarily be formed of a molded rigid polymer or plastic materials such as acrylonitrile butadiene styrene terpolymer (ABS), acetyl, nylon, or the likes. As mentioned above, frame 12 includes fuel supply container holding structure 14 located near first end 16. Frame 12 further includes an insulating cap holding structure 201 located near second end 20, a latch stem holding structure 203, a linking rod support structure 205, an ignitor assembly holding structure 207, a trigger holding structure 209 and a wand receiving structure 211. These structures are adapted to receive and hold the various similarity named components of the lighting mechanism.

Fuel supply container holding structure 14 is configured to receive and hold fuel supply container 22. Fuel container 22 should be positioned within fuel supply container holding structure 14 such that valve 28 is at all times in fluid communication with valve connector 26 in order to ensure proper lighter operation. Valve 28 may either be connected or aligned with valve connector 26.

Preferably fuel supply container holding structure 14 has a curved interior so as to receive fuel supply container 22 with curved exterior body. Alternatively, fuel supply container holding structure 14 can have any other shape to receive and hold fuel supply containers with other exterior shapes. The interior surface preferably is formed by a plurality of bars 252 and connecting members 253. The interior surface can have a solid surface as well.

Along the length of fuel supply container holding structure 14, a plurality of protruding members 221 is provided. Each protruding member 221 includes a hook shaped top 213 so as to securely hold fuel supply container 22. Each protruding member 221 are preferably resilient, so that they may deflect when fuel supply container 22 is inserted and snapped back afterward to securely hold fuel container 22 in place.

The interior surface of fuel supply container holding structure 14 also includes a locating mechanism in the form of a protruding tab 250. Protruding tab 250 is shown positioned on a T-shaped support 251 and extends above the upper surface of the T-shaped support 251. Protruding tab 250 is received in a corresponding recess defined on the fuel supply container 22. As shown in FIG. 1, fuel supply container 22 preferably includes extensions 252 at the top end thereof which assist in supporting the valve actuator 30. Extensions 252 preferably include a hole or recess 254 which is defined to engage the protruding tab 250 on T-shaped support 251. This locating mechanism assists in the alignment of valve 28 to valve connector 26.

Insulating cap holding structure 201, preferably having a semi-cylindrical body, is configured to receive and hold insulating cap 70. Insulating cap holding structure 201 also includes a recess 253 to allow nozzle 18 to pass therethrough. Preferably, insulating cap 70 defines a hollow cylindrical center that fits over insulating cap holding structure 201.

Latch stem holding structure 203 includes a plurality of protruding members, discussed above. At least one of the protruding members of latch stem holding structure 203 is a protruding member 255, which preferably has a T-shape. Furthermore, at least one of the recesses formed within latch support member 43 has a corresponding shape, so as to receive the T-shaped protruding member 255. The T-shaped recess and protruding member 255 in combination with other protruding members and recesses securely affix latch stem 36 on to frame 12. It should be noted, however, a protruding member can be formed on latch support member 43 and a recess can be formed within latch stem holding structure 203. Further, any combination of protruding members and corresponding recesses either on the latch stem receiving structure 203 or latch supporting member 43 can be provided.

Ignitor linking rod support structure 205 is configured to support ignitor linking rod 46 for its sliding movement in forward and rearward directions by suitable support members such as a plurality of support members molded into or protruding from frame 12. At least one of the support members includes a hook 99. Hook 99 is designed to flex during the insertion of ignitor linking rod 46 and to snap back to its original position after rod 46 is inserted.

Ignitor assembly holding structure 207 is configured to firmly hold ignitor assembly 34. Ignitor assembly holding structure 207 includes at least one protruding member 257 formed on frame 12, which may include a hook 259 formed at its distal end. Ignitor assembly holding structure 207 may also include a relief 258 located on each side of protruding member 257. The reliefs 258 are recesses or cut-outs adapted to provide additional flexibility to protruding member 257. Protruding member 257 is also designed to flex and snap back during the insertion of the ignitor 34.

Wand receiving structure 211 includes at least one bar 241 extending from ignitor assembly holding structure 207 to insulating cap holding structure 201. Bar 241 is supported by a plurality of support members such as struts 243. A mold can be modified or inserted to manufacture frame 12 such that bar 241 may have either a round shape or polygonal shape. Each strut 243 may include a recess near its center to allow conduit 24 and wire 54 to pass therethrough. Alternatively, a pair of recesses can be provided on each strut 243 such that one of the recesses holds wire 54 and the other recess holds conduit 24.

Trigger holding structure 209 is configured to hold trigger stem 90 and allow its forward and rearward movements. Trigger holding structure 209 includes a pair of parallel bars 245 spaced apart from each other to receive trigger stem 90. As mentioned above, trigger stem 90 is prevented from separating from trigger holding structure 209 by tab 93.

Figure 3:
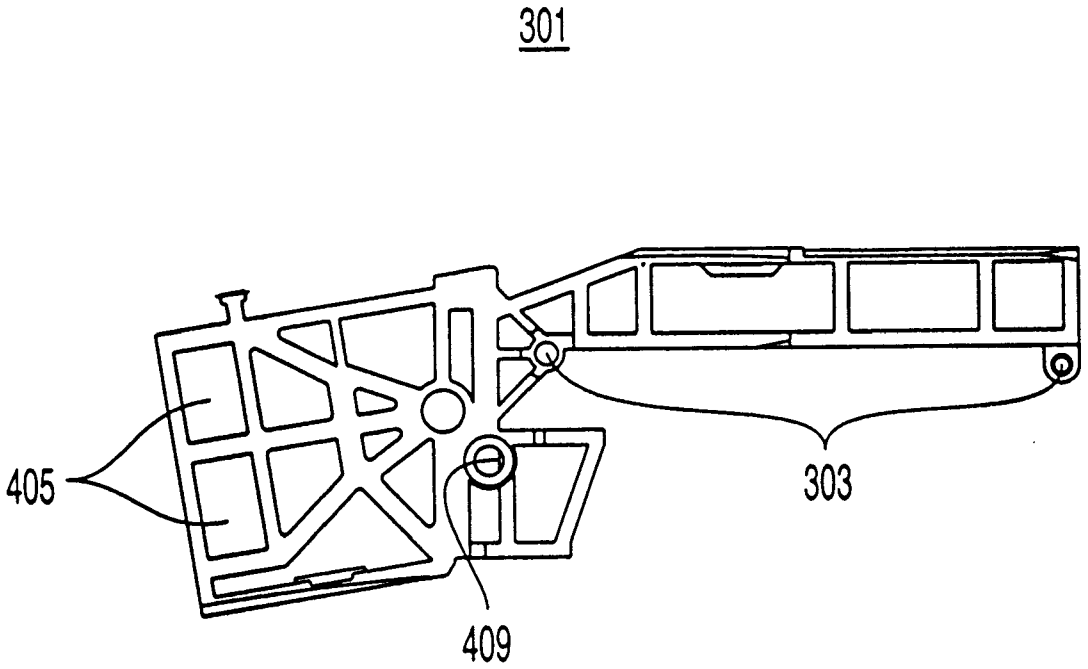
FIG. 3 is a side view of a supplemental frame.

Referring to FIG. 3, an optional supplemental frame 301 is provided to further secure the lighting mechanism to frame 12. Supplement frame 301 preferably covers at least a portion of fuel supply container 22 and biased pivoting member 80. Supplemental frame 301 also may cover portions of ignitor assembly 34, ignitor linking rod 46 and trigger stem 90.

Supplemental frame 301 is made from similar material as that of frame 12. Supplemental frame 301 comprises a plurality of bars 405 connected to each other. Alternatively, supplemental frame 301 can be one solid piece. Supplemental frame 301 also includes a plurality of holes 303. The holes 303 in supplemental frame 301 correspond to holes 305 in frame 12, whereby fasteners, such as threaded screws or rivets, can be used to affix supplemental frame 301 to frame 12. Supplemental frame 301 and frame 12 can also be attached to each other by adhesives or by ultrasonic welding. Alternatively, protruding portions can be formed on the fringes of holes 303 in supplemental frame 301 and recess portions can be formed on the fringes of holes 305 in frame 12, thereby allowing supplemental frame 301 to be snapped on to frame 12 or vice versa. In yet another embodiment, frame 12 and supplemental frame 301 can be affixed to each other by adhesives, ultrasonic welding or other similar means.

It should be noted that supplemental frame 301 is an optional component of the present invention. Frame 12 is preferably designed to securely hold the lighting mechanism without supplemental frame 301.

Referring to FIG. 4, an assembled utility lighter platform 401 includes frame 12, supplemental frame 301, lighting mechanism which includes components described above, and conductive wand 403. Utility lighter platform 401 is a functional lighter, i.e., it is capable of producing a flame. Conductive wand 403 also includes a pair notches 405 stamped thereon. Notches 405 correspond to a pair of knobs 245 formed on bars 241, as shown in FIG. 2. Knobs 245 and notches 405 cooperatively hold conductive shell 403 over wand receiving structure 211.

Referring to FIG. 5, an outer shell 501 is placed over the utility lighter platform 401. By providing the utility lighter platform 401, a variety of outer shells 501 can be provided without having to modify any components of platform 401. For instance, outer shell 501 can be designed to fit within small hands or large hands, to have a full trigger guard or a partial trigger guard (as shown), to have differently shaped wands, and/or to have soft of hard feel grips. Changing market requirements can be met without changing or modifying platform 401 and the lighting mechanism contained therein. In addition, as consumers' tastes change the outer shell 501 can be timely and cost effectively adapted to follow the changing consumer tastes.

It should also be noted that trigger head 91 and the cover for the latch stem 36 can be freely changed without changing the outer shell design. For examples, trigger head 91 can be designed to have different shapes, i.e., circular, half-moon, or square, and the cover for the latch stem 36 can be designed to provide soft feel or to carry commercial logos or insignia thereon.

Outer shell 501 may primarily be formed of a molded rigid polymer or plastic materials such as acrylonitrile butadiene styrene terpolymer (ABS), or the likes. The outer surface of outer shell can have many shapes and sizes, and can also be covered with aesthetically pleasing material such as leather or soft rubber for their soft feel. Alternatively, transparent plastic material can be used to form outer shell 501.

Outer shell 501 preferably is comprised of two halves, which are configured to fit over utility lighter platform 401 and securely snap firmly to each other. Additionally, the two halves can be fastened by a plurality of fasteners, i.e., screws and/or rivets, through a plurality of corresponding holes 505 provided thereon. Preferably, at least one set of corresponding holes is provided to securely fasten frame 12, supplemental frame 301 and outer shell 501 to each other with fasteners. For instance, a hole 507 in outer shell 501 corresponds to a hole 210 in frame 12 which, in turn, corresponds to a hole 409 in supplemental frame 301. Alternatively, the two halves of outer shell 501 can be affixed to each other by adhesives, ultrasonic welding or the likes.

The operation of utility lighter 503 will now be described generally with reference to FIGS. 1, 4 and 5. With one hand, a user grasps handle 501 with the index finger on trigger 38 and the thumb on front end 40 of latch stem 36. Depressing and holding the front end 40 of latch stem 36 downwardly disengage hooked tab 42 from linking rod 46 thereby allowing full movement of trigger 38. Thereafter, the user can pull trigger 38. This action depresses valve actuator 30 through biased pivoting member 80, thereby releasing fuel from fuel supply container 22 through valve 28, valve connector 26, conduit 24 and nozzle 18. At or about the same time, the actuation of trigger 38 rotates arm 86 of pivot 80 in a clockwise direction against linking rod 46. Linking rod 46 moves forward and compresses piezoelectric mechanism 34 to generate a voltage between electrical contacts 48, 50. Electrical current passes from contact 48 into electrically conductive wand 403 and from contact 50 into wire 54, which is connected to the electrically conductive nozzle 18. A spark is thereby generated between nozzle 18 and tab 60 in the wand to ignite the air/gas mixture in the vicinity of the nozzle outlet. The resulting ignited fuel passes through hole 66. As long as the user continues to depress front end 40 of latch stem 36, the trigger may be repeatedly pulled, and the piezoelectric mechanism 34 and valve actuator 30 may be actuated repeatedly to generate a flame in the event that the first actuation does not produce a flame.

When the user releases trigger 38, biased pivoting member 80 is biased, e.g., by the return spring in the piezoelectric ignitor, in a counterclockwise position to disengage valve actuator 30 in order to close valve 28 and shut off the supply of fuel to nozzle 18. This extinguishes the flame emitted from hole 66. When the user releases latch stem 36 and the trigger is returned, hooked tab 42 re-engages the recess or stop member structure 44 on linking rod 46 thus preventing actuation of the lighter. Therefore, as front end 40 of latch stem 36 is normally biased in this upward position such that hooked tab 42 re-engages link member 46, a user cannot inadvertently leave lighter 503 in a state where trigger 38 may simply be pulled to activate the lighter. Also, the relative difficulty of operating both the latch stem and the trigger essentially at the same time further increases the skills required to operate the lighter. Although the operation of utility lighter 503 is described with respect to the lighting mechanism illustrated in FIGS. 1, 4 and 5, the utility lighter platform of the present invention may be used with other types of lighting mechanism that are different than the lighting mechanism described herein. Examples of other lighting mechanisms included those described in U.S. Pat. Nos. 5,697,775, 5,326,256, 3,947,731, 4,292,021, 4,778,380, 5,154,601 and 5,738,507. Thus, the present invention is not to be limited to the lighting mechanism described herein.

While various descriptions of the present invention are described above, it should be understood that the various features can be used singly or in any combination thereof. Therefore, this invention is not to be limited to only the specifically preferred embodiments depicted herein.

Further, it should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A utility lighter platform comprising:

a fuel supply container holding fuel therein;

a valve actuator associated with the fuel supply container for selectively releasing fuel therefrom;

an ignitor assembly configured to generate a spark to ignite the released fuel; and a frame configured to operatively house the fuel supply container, the valve actuator, and the ignitor assembly as a functional unit with structural integrity, the frame further configured to receive an outer shell to cover a portion of the frame with the outer shell substantially covering the fuel supply container, the valve actuator, and the ignitor assembly.

2. The utility lighter platform of claim 1 wherein the outer shell includes an ergonomically designed handle.

3. The utility lighter platform of claim 1 further comprising a supplemental frame configured to house at least the fuel supply container when affixed to the frame.

4. The utility lighter platform of claim 1 further comprising an actuating assembly associated with the valve actuator to dispense the fuel from the fuel supply container and with the ignitor assembly to generate the spark.

5. The utility lighter platform of claim 4 wherein the frame is further configured to operatively house the actuating assembly.

6. The utility lighter platform of claim 4 further comprising a latch stem associated with the actuating assembly and configured to selectively prevent operative movement the actuating assembly, wherein the latch stem further comprises a hooked tab connected for biased movement relative to the actuating assembly and normally biased into engagement with the actuating assembly to prevent the operative movement thereof, wherein the user may selectively bias the hooked tab out of engagement with the actuating assembly to permit operation of the actuating assembly.

7. The utility lighter platform of claim 6 wherein the frame is further configured to operatively house the latch stem.

8. The utility lighter platform of claim 1 further includes a trigger assembly configured to activate the valve actuator and the ignitor assembly.

9. The utility lighter platform of claim 8 wherein the frame is further configured to house the trigger.

10. The utility lighter platform of claim 8 further comprising a biased pivoting member operatively associated with the trigger assembly and the ignitor assembly for activating at least the ignitor assembly when the trigger is moved toward the valve actuator.

11. The utility lighter platform of claim 10 wherein the frame is further configured to operatively house the biased pivoting member.

12. A utility lighter frame comprising:

a fuel supply container housing structure configured to hold a fuel supply container;

an ignitor assembly holding structure configured to house an ignitor assembly; and a trigger holding structure configured to hold a trigger stem with which to activate the ignitor assembly and to release fuel from the fuel supply, wherein the frame is further configured to receive an outer shell to cover a portion of the frame with the outer shell substantially covering the fuel container, the ignitor assembly, and the trigger holding structure, and wherein the frame operatively houses the fuel supply container, the ignitor assembly, and the trigger holding structure as a functional unit with structural integrity.

13. The utility lighter frame according to claim 12 wherein the fuel supply container housing structure comprises a plurality of protruding members configured to securely hold the fuel supply container.

14. The utility lighter frame according to claim 12 further comprising a latch stem receiving structure configured to receive a latch stem which prevents operative movement of the trigger.

15. The utility lighter frame according to claim 12 wherein at least one protruding member is configured to hold the fuel supply container.

16. The utility lighter frame according to claim 14 wherein the latch stem receiving structure comprises at least one corresponding shaped protruding member in order to securely hold the latch stem.

17. The utility lighter frame according to claim 14 wherein the latch stem comprises at least one corresponding shaped protruding member in order to securely hold the latch stem receiving structure.

18. The utility lighter frame according to claim 14 wherein the latch stem includes a shank portion adapted to receive a cover.

19. The utility lighter frame according to claim 12 wherein the ignitor assembly holding structure comprises at least one recess and one protruding portion for securely housing the ignitor assembly.

20. The utility lighter frame according to claim 12 wherein the trigger holding structure comprises a pair of bars spaced apart from each other to operatively receive the trigger.

21. The utility lighter frame according to claim 12 further comprising an insulating cap holding structure configured to receive an insulating cap and configured to house a nozzle operatively connected to the fuel supply.

22. The utility lighter frame according to claim 21 wherein the insulating cap holding structure comprises a semi-cylindrically shaped body defining a hollow center therein to receive the nozzle.

23. The utility lighter frame according to claim 21 further including a wand receiving structure configured to receive an electrically conductive wand.

24. The utility lighter frame according to claim 23 wherein the wand receiving structure is formed between the insulating cap holding structure and the ignitor assembly holding structure, wherein the wand receiving structure comprises a plurality of struts with recesses formed thereon to receive a conduit which connects the nozzle to the fuel supply.

25. The utility lighter frame according to claim 24 wherein the insulating cap holding structure is further configured to provide a spark gap between the wand and the nozzle.

* * * * *